United States Patent [19]

Beatty

[11] Patent Number: 4,895,079

[45] Date of Patent: Jan. 23, 1990

[54] VEHICLE HAULING PROCESS AND APPARATUS

[76] Inventor: Robert A. Beatty, 76 78 Hayes Avenue, Camira, Queensland 4300, Australia

[21] Appl. No.: 282,859

[22] Filed: Dec. 9, 1988

Related U.S. Application Data

[63] Continuation of Ser. No. 27,444, Mar. 18, 1987, abandoned.

[30] Foreign Application Priority Data

Mar. 19, 1986 [AU] Australia ..... PH5109

[51] Int. Cl.[4] ..... B61B 11/00

[52] U.S. Cl. ..... 104/174; 104/175; 104/183

[58] Field of Search ..... 104/174, 173.1, 173.2, 104/175, 178, 183, 196, 180, 197, 179; 254/277, 274, 276, 392, 321, 270, 272, 273; 226/11; 187/81, 110, 112; 290/1 D; 105/49, 50, 27, 161; 299/18

[56] References Cited

U.S. PATENT DOCUMENTS

| | | | |
|---|---|---|---|
| 293,049 | 2/1884 | Mayor | 104/174 |
| 498,274 | 5/1893 | James | 104/174 |
| 772,733 | 10/1904 | Morgan | 104/174 |
| 1,127,713 | 2/1915 | Yates et al. | 187/81 |
| 1,216,694 | 2/1917 | Jenkins | 104/289 |
| 3,311,351 | 3/1967 | Blakely | 254/392 |
| 3,554,132 | 1/1971 | Hanna | 104/178 |
| 3,809,832 | 5/1974 | Burger | 104/178 |
| 4,046,355 | 9/1977 | Martin | 254/273 |
| 4,359,207 | 11/1982 | Maryonovich et al. | 254/272 |
| 4,466,669 | 8/1984 | Sellers | 299/18 X |
| 4,474,266 | 10/1984 | Kallis | 187/110 |
| 4,662,586 | 5/1987 | Naumann | 254/283 |

FOREIGN PATENT DOCUMENTS

| | | | |
|---|---|---|---|
| 78292 | 11/1928 | Fed. Rep. of Germany | 104/174 |
| 918447 | 4/1982 | U.S.S.R. | 299/18 |

*Primary Examiner*—Johnny D. Cherry
*Assistant Examiner*—Joseph D. Pape
*Attorney, Agent, or Firm*—Kenyon & Kenyon

[57] ABSTRACT

A process is described for hauling a loaded motorized dump truck up an untracked incline typically found in mining situations. The process makes use of the momentum of an unloaded dump truck to facilitate the hauling of the loaded truck. In one form of the invention, the two trucks are coupled. In another form, the energy generated by the unloaded truck as it moves down, is stored and used to help raise a loaded truck.

7 Claims, 7 Drawing Sheets

VEHICLE HAULING PROCESS AND APPARATUS

This application is a continuation of application Ser. No. 027,444, filed 3/18/87 now abandoned.

This invention relates to an improved vehicle hauling process especially adapted for, but not necessarily restricted to, mining operations and in particular open cut mining operations.

It is common practice for open cut mines to utilise dump trucks in their day to day operations. These vehicles are used for transporting mined materials along haul roads, from their point of loading to their point of dumping and returning to the point of loading as a continuing cycle. The materials carried typically include, but are not necessarily restricted to, ore material and waste material. In traversing haul roads, it is common for the trucks to negotiate an inclined roadway usually described as a "Ramp", an "Inclined Ramp", or a "Haul Ramp", for the purpose of elevating the truck during travel either to or from the point of loading. For example, we shall refer to a process for carting coal from a coal seam at the bottom of an open cut to the coal treatment plant situated at natural surface level before returning to the open cut again for another load. In completing such a cycle, it is common for the truck to traverse a variety of road slope conditions including up slopes, down slopes and horizontal travel. When traversing up slopes, it is usual for the truck driver to select a lower gear ratio to enable the truck to better negotiate the slope. Selecting a lower gear has the effect of reducing the truck speed and increasing the tractive effort applied to the driving wheels. Similarly in negotiating a down slope the truck driver may apply the truck brakes or a similar retarding device for the purpose of controlling the speed of the descending truck. Mining depths increase with time during the common course of open cut mining operations, and it is usual for the length of the haul ramps to be increased to meet the greater depth requirements of mining. By increasing the ramp length, the period of slow, low gear, up hill travel is increased for the dump trucks. Similarly, the period of down travel under brakes or similar retarding device is increased.

It therefore is an object of the invention to provide a vehicle hauling process and apparatus which alleviates the impact of increasing ramp lengths on the cycle times and maintenance requirements for vehicles and in particular dump trucks.

The process of the invention includes the following steps:

(i) attaching a line member to a loaded vehicle at the bottom of a ramp;

(ii) attaching the same or a separate line member to an unloaded or empty vehicle at the top of the ramp; and (iii) facilitating haulage of the loaded vehicle up the ramp by using the momentum of the unloaded or empty vehicle in its travel down the ramp. Preferably the line member(s) is or are movably retained in position by support means at the top of the ramp.

In the aforementioned process the line member(s) may be in a slack or untensioned attitude during steps (i) and (ii) and prior to step (iii). During step (iii) the line member(s) may then adopt a tensioned attitude in its movement using the support means and suitable bearing means.

It also will be appreciated that steps (i) or (ii) do not have any order of sequence and thus step (ii) may precede step (i) if desired.

The line member may be of any suitable type and thus comprise a length of cable, rope, wire, chain or the like.

The support means in one embodiment may comprise a pulley or sheave comprising a peripheral groove or chain engaging teeth which engages with the line member. However, it will be appreciated that if desired a plurality of pulleys may be utilized all of which engage the line member in suitable manner. Thus all pulleys may be located in line or in a row whereby the line member may engage with the peripheral groove of both outer pulleys and also with the peripheral groove of the intermediate pulley. In one arrangement the line member may adopt a straight line only engaging with the rear surfaces of all of the pulleys or alternatively the line member may alternately engage with a rear surface of an outer pulley, a front surface of an adjacent pulley and a rear surface of an adjoining pulley and so on so that it may adopt a tortuous or serpentine path.

There also may be provided retention means associated with the or each pulley or sheave wheel so as to retain the line member in the peripheral groove of the or each pulley. This may include for example an arcuate capping member or circular guard member of arcuate cross section which is spaced from the peripheral groove of the or each pulley.

Where shock absorbing means is employed as hereinafter described, it is preferred that the pulley(s) may be movably mounted to appropriate mounting means. If the shock absorbing means is omitted the pulley(s) may be fixedly attached to the mounting means.

In one form of mounting means the or each pulley could form part of a pulley assembly which has a base portion rigidly mounted to a suitable base structure or is immovably embedded in the ground. In this embodiment each pulley wheel may rotate in conjunction with suitable bearing means associated with an associated pulley assembly.

There also may be provided shock absorbing means associated with the support means. This may be hydraulically, pneumatically or mechanically actuated and thus may be of any suitable type. In one form an axle of the or each pulley wheel may be directly attached to a piston of a pneumatic or hydraulic ram assembly or to a large spring member attached to a fixed support. The purpose of the shock absorbing means is to attain a balanced or equilibrium state wherein the tension in the line member is approximately equal to the pressure in the hydraulic or pneumatic ram assembly. It is then possible by the provision of the shock absorbing means to take into account sudden surges of tension in the line member caused for example by the loaded vehicle striking an obstruction or portion of steeper slope on the ramp.

In the case of the situation where the shock absorbing means is utilized there also may be provided fixing means or a support to which the shock absorbing means is attached. The fixing means could for example comprise a post or other suitable structure embedded in the ground in concrete. The shock absorbing means is usefully adopted when one vehicle (ie. loaded or empty) starts ahead of the other vehicle.

The line member may be constructed as to be able to carry an electrical signal from one vehicle to the other about to be attached to the line member. This will enable the installation of safety interlocking electronic apparatus suitable for indicating to both drivers that the line member is securely attached to their vehicles.

The pulley wheel as one form of support means may in some circumstances be replaced by a winch means wherein the line member may engage with a winch drum of the winch means. Suitably the winch means is power actuated and thus may have associated therewith a motor-generator set. In this arrangement the line member is attached to and wound around the winch drum. Upon travel of a descending vehicle coupled to the line member the mechanical energy supplied to the winch means would be converted to electrical energy by the motor generator set and either returned to an associated electrical grid distribution system or supplied to a second winch drum connected to a loaded vehicle ascending the ramp thereby assisting in pulling the loaded vehicle up the ramp. This embodiment has the advantage over the previously described pulley wheel embodiment in that the loaded and empty vehicles do not necessarily have to be on the same winch ropes at the same time, thereby providing additional flexibility in scheduling the movements of the vehicles.

In the winch means embodiment described above there may be provided a pair of winches electrically coupled to each other by the motor generator set. This means both winches may operate simultaneously through the motor generator set although of course it will be appreciated that both winches may operate independently of each other eg. through associated motor generator sets not connected with each other.

However, in the latter embodiment described above it will be appreciated that the electrical energy generated by movement of an unloaded or empty vehicle down the ramp in the electrical grid system may be stored until such time as it is desired to draw the energy to haul a loaded vehicle up the ramp.

The motor generator set may include an AC motor driving DC generators which in turn provide DC power for DC motors coupled to an associated winch drum through an appropriate gearing arrangement.

The use of motor generator sets as described above has an advantage in allowing an empty or unloaded vehicle to operate down the ramp on its own using a first power winch or in conjunction with a full vehicle being hauled up the ramp using a second power winch. The motor generator set(s) and winch or winches may be conveniently mounted on a mechanical walking, or tracked or wheel supported platform as is the conventional arrangement with a dragline type excavator. Such a movable platform mount provides the advantage of mobility in transferring the winch or winches from one haul ramp to another haul ramp as mining operations proceed.

It also will be appreciated from the foregoing that the pulley(s) may also be mounted on the mechanical walking platform or tracked or wheel supported mounting means.

The pulley wheel as one form of support means may in some circumstances be replaced by an endless rope or cable system supported by a pulley wheel at the top of the ramp and a similar pulley wheel at the bottom of the ramp. In this configuration the line member would be retained substantially at the level of the road surface and a dump truck could be connected or disconnected from the line member by means of a suitable clamping device. Such clamping device may be remotely controlled by the truck driver thereby avoiding the need for a groundsman to connect and disconnect the line member. As a further refinement to this option, one or both of the terminal pulley devices may be power connected to a motor-generator set to provide similar benefits and flexible mode of operation as described previously.

Under some circumstances it may be practical and more beneficial to attach two or more vehicles to each end of a common line member rather than the pair described previously. This could be accomplished by attaching one or more auxiliary vehicles to a primary vehicle attached to the line member at each end.

Reference may now be made to preferred embodiments of the invention as shown in the attached drawings wherein.

Figure 13:
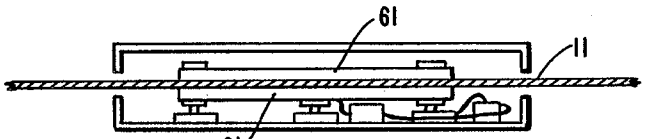
Figure 14:
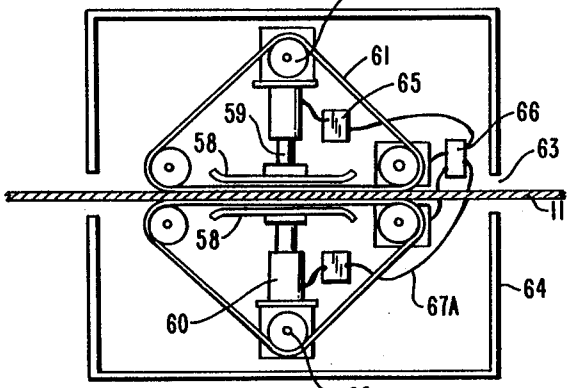
Figure 15:
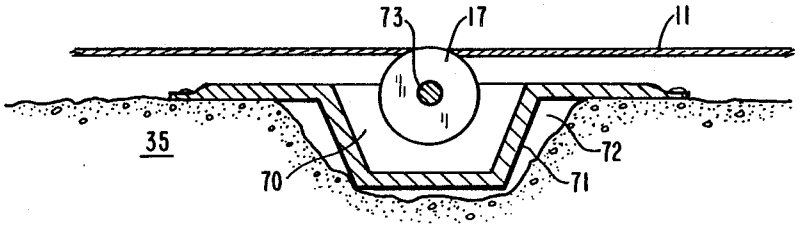
Figure 16:
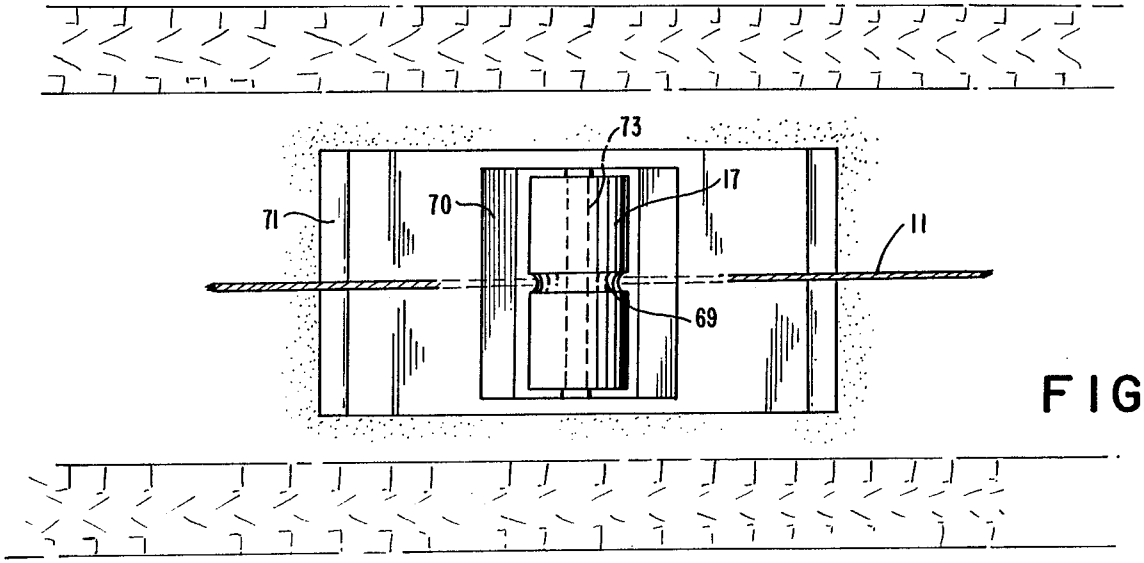

FIGS. 11–14 describe alternative forms of control devices which may be utilized in the vehicle hauling appratus of the invention to prevent undesired movement in the cable upon breaking thereof; and FIGS. 15–16 illustrate a preferred form of idler support roller located on an inclined ramp for supporting a cable.

Figure 1:
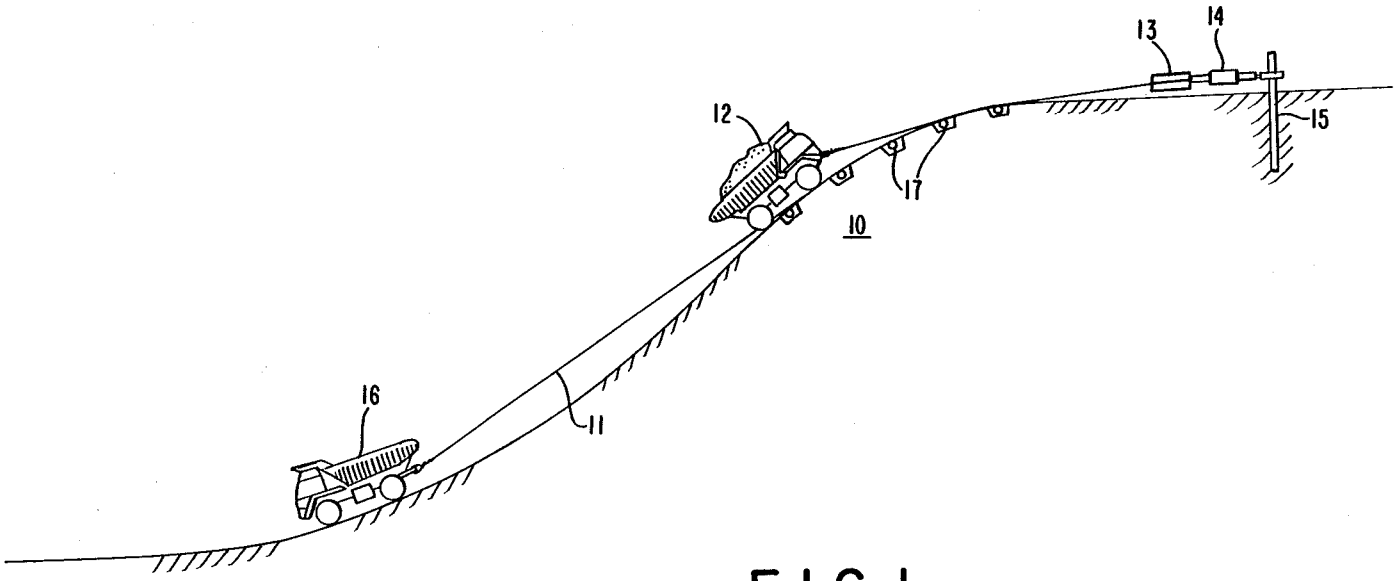
FIG. 1 is a sketch of a vehicle hauling apparatus of the invention in sectional view.
Figure 2:
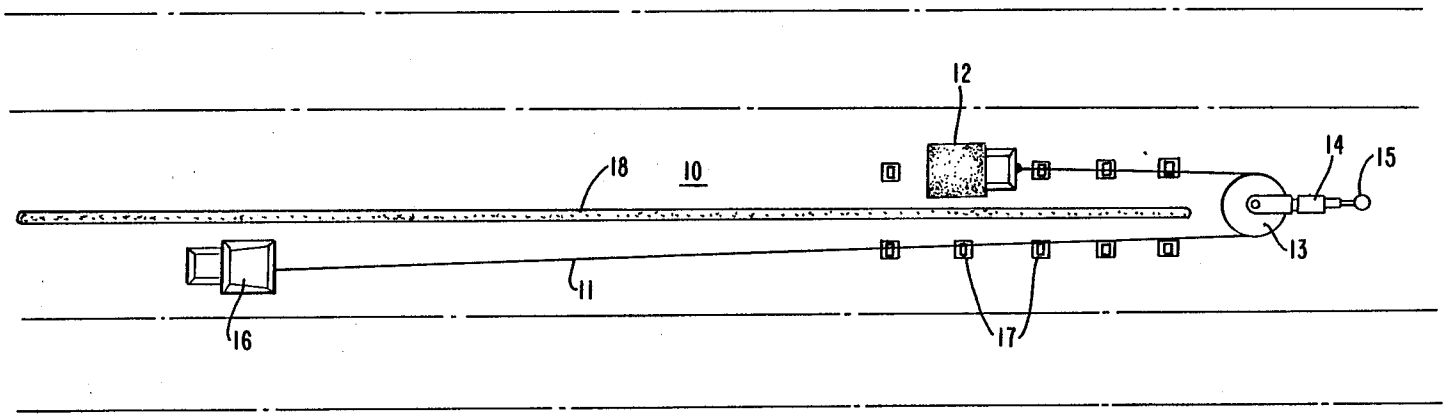
FIG. 2 is a plan view of the vehicle hauling apparatus shown in FIG. 1.
Figures 3, 4, 5:
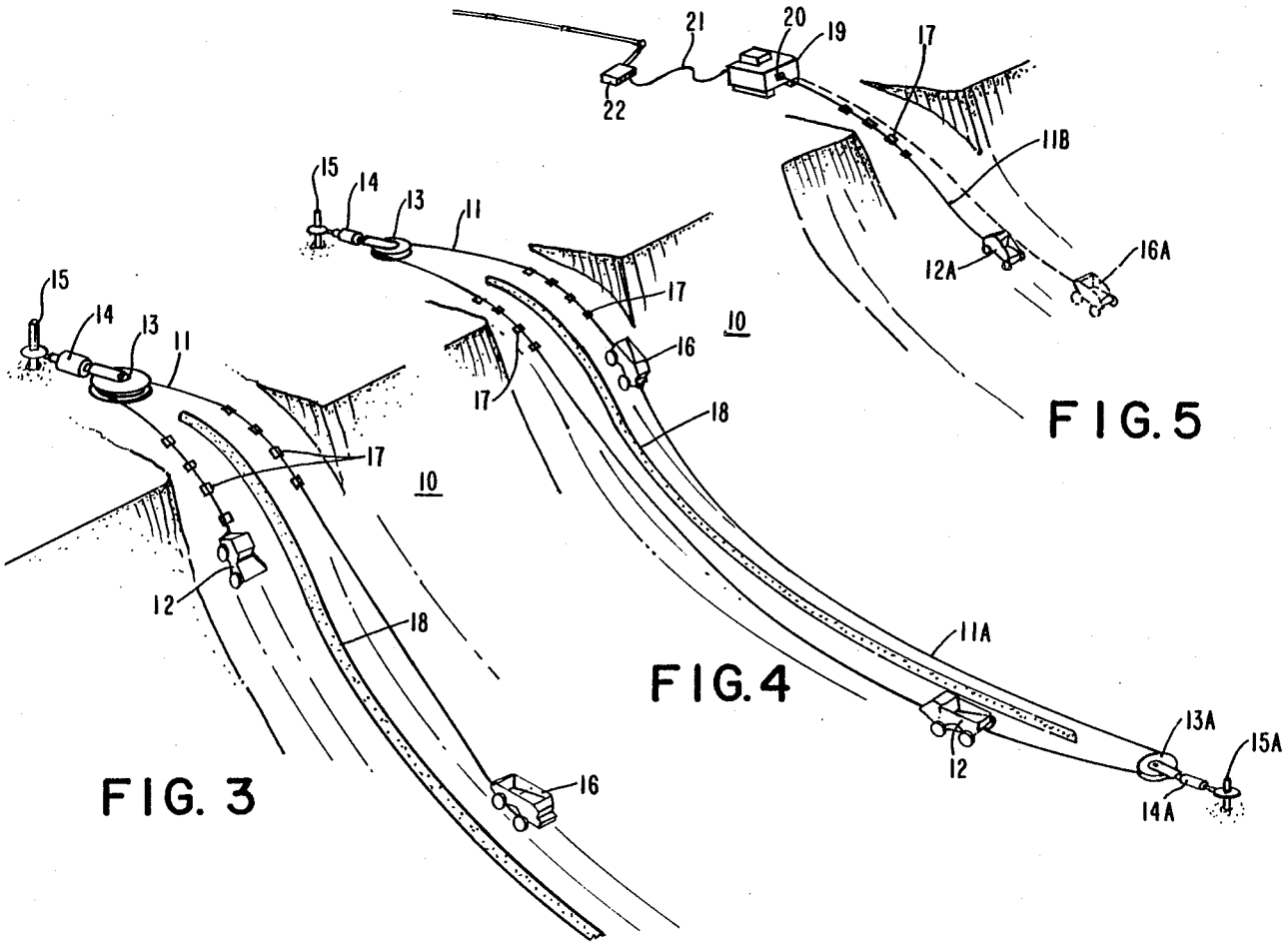
FIG. 3 is a perspective view of the vehicle hauling apparatus shown in FIG. 1.
FIG. 4 is a perspective view of a modified vehicle hauling apparatus also constructed in accordance with the invention.
FIG. 5 is a perspective view of another modified vehicle hauling apparatus constructed in accordance with the invention which is different to the apparatus shown in FIGS. 1 or 4.

In the drawings shown in FIGS. 1–3 the vehicle hauling process of the invention which may suitably be called "truck jigging" is shown which may be used to reduce the effective truck cycle times on ramp inclines. A suitably sized cable (11) is attached to a full truck (12) at the bottom of the ramp (10). The cable (11) is passed over or around a fixed pulley sheave (13) at the top of the ramp and has a free end attached to an empty truck also at the top of the ramp. The empty truck (16) then descends the ramp (10), either under driven power or under gravity, pulling cable (11) and hence the full truck (12), which is driven under its own power, up the ramp at the same time. When the full truck reaches the top of the ramp and the empty truck reaches the bottom, the cable (11) is detached from both trucks and another pair of trucks connected. The sheave wheel (13) is connected to a shock absorbing device (14) of suitable size, which in turn is connected to a fixed support (15). A multiplicity of spaced rope support or idler rollers (17) are installed in the haul road pavement to support the cable or jig rope (11) when it would otherwise foul the brow of the ramp. A dividing windrow(18) of spoil material, concrete or other similar material is placed between the ascending and descending truck paths for safety reasons and a separate ramp or ramps may be provided for other mine vehicles.

In FIG. 4 there is shown an arrangement which has been described previously in regard to the use of an endless rope or cable (11A) which is supported by sleeve wheel (13), shock absorbing device (14) and fixed support (15) at the top of ramp (10) and by sheave wheel (13A), shock absorbing device (14A and fixed support (15A) at the bottom of ramp (10). Endless cable (11A) may be connected or disconnected to full vehicle (12) and empty vehicle (16) when required by any suitable hitch or clamping device (not shown).

In FIG. 5 there is shown a full vehicle (12A) in full outline attached to a mechanical walking device (19) utilized in conventional dragline operations which has associated therewith a power winch (20). Alternatively device (19) could be replaced with crawler tracks as is known in the art. The device (19) may be connected by trailing cable (21) to a suitable transforming device (22) connected to the main electrical supply. The device (19) may include a motor generator set which may be used to store electrical energy in the electrical grid system which is generated by movement of empty vehicle (16A) shown in phantom down ramp (10) until such time as is considered appropriate to draw a full vehicle (12A) up the ramp (10) as described previously.

Figure 6:
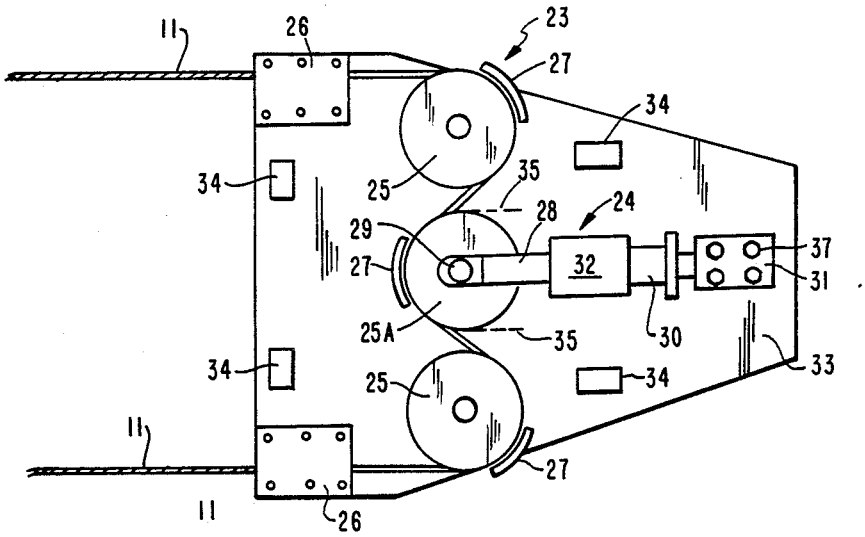
FIG. 6 is a plan view of a pulley wheel assembly and energy absorbing device as described previously mounted to a fixed support.
Figure 7:
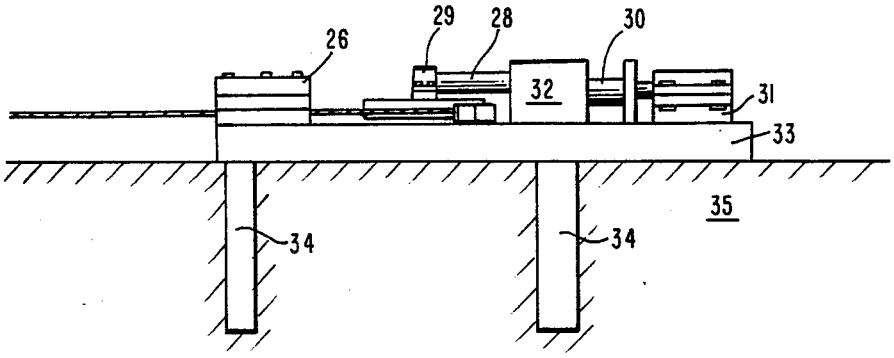
FIG. 7 is a side view of the arrangement shown in FIG. 6.

In FIGS. 6–7 there is shown other variations in regard to a sheave or pully wheel assembly (23) coupled to an energy absorbing device (24) Pulley wheel assembly (23) includes spaced pulley wheels (25) engaging with cable (11) as described previously. The cable (11) extends through guides (26) as shown and also engages with arcuate guard members (27). The middle pulley wheel (25A) may be attached to a movable piston (28) at (29). The movable piston may extend through cylinder (30) which is attached to a fixed support (31) by bolts (37). Movable piston (28) may be actuated by hydraulically or pneumatically and is supported by fixed housing (32). Pulley (25A) may be slidably attached to a base structure (33) which is supported by fixed ports (34) embedded in ground (35) by concrete or other suitable means. The pulley (25A) may be slidably mounted to base structure (33) such as in tracks or grooves (35).

Figure 9:
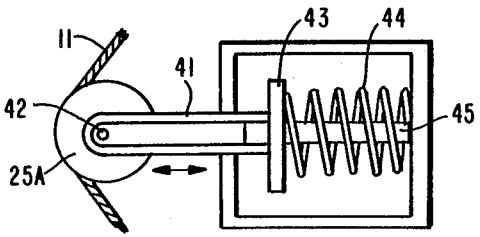
FIGS. 8–10 are alternative forms of energy absorbing devices that may be utilized in the present invention.
Figure 8:
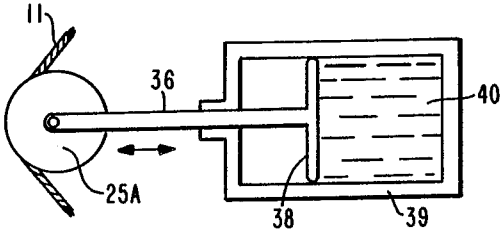
Figure 10:
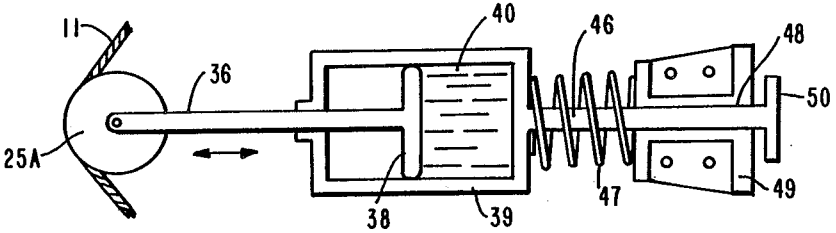

FIGS. 8–10 show other forms of shock absorbing devices that may be utilized in the present invention. FIG. 8 illustrates middle pulley (25A) movably supported by piston rod (36) and associated piston (38) which is located in cylinder (39). Fluid (40) such as grease or hydraulic fluid, oil or compressible gas may be contained in cylinder (39).

Alternative in FIG. 9 there is utilized a support rod (41) attached to movable central pulley (25A) at (42). A rod (41) at its other end as shown has a piston member (43) and associated spring (44) which is wound around stem (45) supporting piston member (43).

In FIG. 10 a combination of the devices shown in FIGS. 8–9 may be utilized wherein cylinder (39) is provided with stem (46) having spring (47) wound thereon. Stem (46) engages in passage (48) of fixed support (49) and retained therein by abutment (50).

In some cases there also may be provided control device for sensing a broken cable. This may operate in regard to a device for sensing the cable tension, a device which determines the rate of acceleration or speed of the vehicle being hauled up the ramp or an electrical device wherein a break in the electrical circuit will indicate the presence of a broken cable.

In FIGS. 11–14 various forms of possible sensing devices are illustrated in regard to a wheel (13). In the arrangement shown in FIGS. 11–12 a windlass or drum (13B) engages cable (11) as shown. Windlass (13B) is supported on axle (51) mounted in bearing blocks (52). There is provided a braking disc (53) mounted to axle (51) which may be braked by calipers or jaws (54). Movement of calipers (54) may be actuated by control bos (55) which is controlled electrically by sensing device (56) which engages cable (11). The sensing device may also be located in the windlass or drum such as at (57).

In FIGS. 13–14 there is shown a clamping assembly wherein cable (11) may pass through opposed clamping jaws (58). Each clamping jaw (58) is attached to a piston (59) associated with hydraulic cylinder (60). There is also shown a continuous belt (61) which moves continuously being supported on idlers (62) as the cable (11) passes through openings (63) of housing (64). There is also shown hydraulic actuator (65) and control box (66), conductors (67A) are also illustrated. Upon a break occuring in cable (11) the clamping jaws (58) will engage cable (11) preventing further movement.

Figure 11:
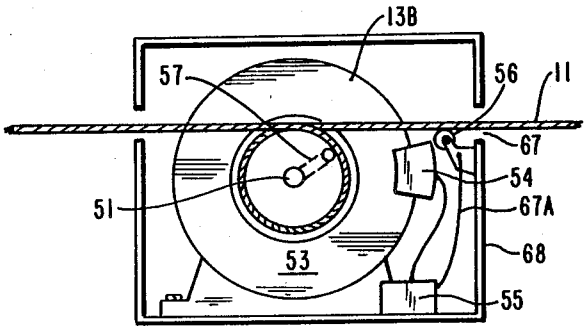
Figure 12:
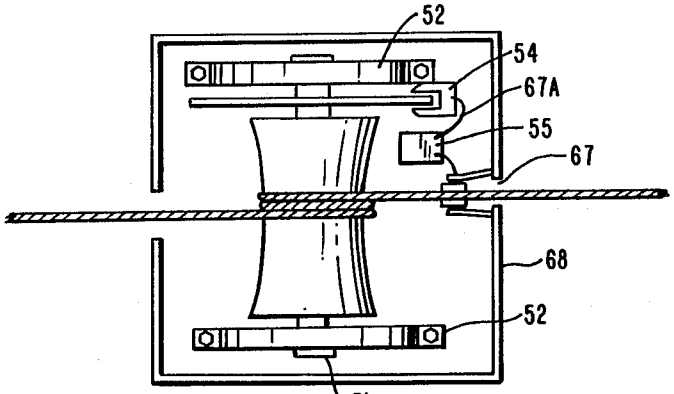

In the arrangement shown in FIGS. 11–12 a break in cable (11) will automatically actuate movement of calipers (54) to prevent rotation of brake disc (53). In FIGS. 11–12 cable (11) passes through openings (67) in housing (68). The support rollers (17) are shown in more detail in FIGS. 15–16 wherein a roller (17) is provided with groove or track (69) for supporting cable (11). Roller (17) may be mounted on a support member (70) located in base structure (71) located in hole (72) in ground (35). The idler roller is mounted on axle (73) which is journalled for rotation in support member (70)

On more steeply dipping haul ramps, it may be more beneficial to jig the full truck up the slope in the reverse direction rather than the forward mode shown in FIGS. 1 and 2. This arrangement may have particular application in assisting to restrain the load within the dump truck body during the inclined travel up the ramp slope. Under this arrangement it may also be necessary to mount additional wheels on the front of the dump trucks to support the additional load transferred to those wheels during up ramp jigging operations.

The advantages of this system in relation to conventional truck ramp operations may be summarised as follows:

(a) The net vehicle weights of both trucks approximately counter balance each other thereby substantially reducing grade effects from the traction calculation, and thus allowing steeper grades to be contemplated for haul ramps. Using steeper ramp grades reduces the mining voids required to cater for shallow graded ramps, and therefore increases the amount of room available for spoil dumps or the amount of rock excavation required. This also simplifies spoil reclamation activities. The limiting steepness of ramp grades as proposed in the invention, depends on other factors such as; retaining the load in the body of the truck, or maintaining a steeply inclined road surface, or maintaining lubricating oil and other fluid levels in trucks, or gaining sufficient traction between the truck driving wheels and the ramp surface. Theoretically, by using the invention, trucks can be operated directly up a steeply inclined coal floor, or even up the side of a spoil pile.

(b) The effective engine power from both trucks can be applied to the task of elevating the load in the full truck and overcoming any additional friction forces present.

(c) The descending truck does not use fuel or brakes to retard its descent down the ramp and the full truck spends less time under full power ascending the ramp, leading to operating cost savings.

(d) The truck cycle times are reduced, because in long ramp hauls, the time saved in elevating the full truck more rapidly up the ramp using the invention as opposed to the truck negotiating the ramp under its own power only, is less than the time lost in connecting and disconnecting the two trucks from the jig rope and the slower trip for the empty truck descending the ramp. Reduced truck cycle times results in fewer trucks being required to accomplish a given mine trucking task, leading to lower capital and operating costs.

I claim:

1. A method of mining an open cut mine so as to provide for transfer of mined material from the open cut mine to the top of a trackless incline adjacent thereto, comprising the steps of:

(i) attaching a line member to a first unloaded motorized vehicle supported by ground engaging wheels at the top of the incline;

(ii) attaching said line member to a second motorized vehicle, said second motorized vehicle being loaded with mined material and supported by ground engaging wheels at the bottom of said incline;

(iii) hauling the loaded motorized vehicle using its motive power up to the top of the incline and assisting said hauling by lowering of said first unloaded motorized vehicle from the top of said incline down the incline; and (iv) loading said first motorized vehicle with mined material at the bottom of said incline; and (v) unloading the second motorized vehicle at the top of said incline.

2. The method of claim 1 further comprising the steps of sensing said line member for breaks.

3. The method of claim 2 further comprising the step of braking said line member when a break is sensed.

4. The method of claim 1 wherein said line member is supported by a plurality of pulleys including outer pulleys and an intermediate pulley, comprising the step of threading said line member on a rear face of said outer pulleys and a front face of said intermediate pulley to form a serpentine path.

5. A method of mining an open cut mine so as to provide for transfer of mined material from the open cut mine to the top of a trackless incline adjacent thereto, comprising the steps of:

(i) storing electrical energy in a motor generator set by movement of a first motorized vehicle supported by ground engaging wheels down the trackless incline, said first vehicle being attached to a first line member associated with said motor generator set;

(ii) attaching a second line member to a second motorized vehicle loaded with mined material and supported by ground engaging wheels at the bottom of the incline;

(iii) supporting said second line member with pulleys located along the length of the incline;

(iv) assisting in hauling said second motorized vehicle using its motive power up the incline by a power winch actuated by said stored electrical energy by pulling on said second line member; and (v) unloading said second motorized vehicle at the top of the incline.

6. The method of claim 5 further comprising the step of locating said power winch on a mobile device connected to a main power supply.

7. A method of mining an open cut mine so as to provide for transfer of mined material from the open cut mine to the top of a trackless incline adjacent thereto, comprising the steps of:

(i) attaching a line member to a first unloaded motorized vehicle supported by ground engaging wheels at the top of the incline;

(ii) attaching said line member to a second motorized vehicle, said second motorized vehicle being loaded with mined material and supported by ground engaging wheels at the bottom of said incline;

(iii) hauling the loaded motorized vehicle using its motive power up the incline and assisting said hauling by lowering of said first motorized vehicle from the top of said incline down the incline;

(iv) detaching both vehicles from the line member;

(v) unloading the second motorized vehicle at an unloading point near the top of said incline, and (vi) travelling the first motorized vehicle to a loading station adjacent an excavation site.

* * * * *